US006012930A

United States Patent [19]

Tokuwa et al.

[11] Patent Number: 6,012,930

[45] Date of Patent: Jan. 11, 2000

[54] CONNECTOR FOR CIRCUIT BOARD

[75] Inventors: Koichiro Tokuwa; Kiyofumi Ichida, both of Yokkaichi, Japan

[73] Assignee: Sumitomo Wiring Systems, Ltd., Japan

[21] Appl. No.: 09/089,094

[22] Filed: Jun. 2, 1998

[30] Foreign Application Priority Data

Jun. 13, 1997 [JP] Japan ..... 9-156819

[51] Int. Cl.[7] ..... H01R 9/09

[52] U.S. Cl. ..... 439/79

[58] Field of Search ..... 439/79, 80

[56] References Cited

U.S. PATENT DOCUMENTS

| | | | |
|---|---|---|---|
| 5,032,085 | 7/1991 | Alwine et al. | 439/79 |
| 5,507,659 | 4/1996 | Sumida et al. | 439/79 |
| 5,511,984 | 4/1996 | Olson et al. | 439/79 |
| 5,593,307 | 1/1997 | Bale et al. | 439/79 |
| 5,676,554 | 10/1997 | Tsuji | 439/79 |
| 5,827,077 | 10/1998 | Fukuda | 439/79 |

FOREIGN PATENT DOCUMENTS

| | | |
|---|---|---|
| 8-273773 | of 1996 | Japan . |
| 8-315930 | of 1996 | Japan . |

*Primary Examiner*—Steven L. Stephan
*Assistant Examiner*—T C Patel
*Attorney, Agent, or Firm*—Anthony J. Casella; Gerald E. Hespos

[57] ABSTRACT

A connector is provided to prevent the deformation of base end portions of L-shaped lead terminals. The connector has a restricting projection 13 projects on the rear surface of the connector housing 10 so as to surround substantially the half of a base end portion 24U of each lead terminal 20U near a connector housing 10. Accordingly, even if an external bending force acts on the base end portions 24U, the deformation of the base end portion 24U is prevented by the restricting projection 13.

7 Claims, 4 Drawing Sheets

CONNECTOR FOR CIRCUIT BOARD

BACKGROUND OF THE INVENTION

1. Field of the Invention

The present invention relates to a connector for a circuit board.

2. Description of the Prior Art

A prior art connector for a circuit board is, as shown in FIG. 5, and is constructed such that a plurality of lead terminals 2A, 2B are pressed into a connector housing 1. Projecting portions of the lead terminals 2A, 2B are bent into an L-shape behind the rear surface of the connector housing 1, and the leading ends thereof serve as board mount portions 5A, 5B to be fitted into through holes 4 formed in a circuit board 4.

In the prior art connector of FIG. 5, the lead terminals 2A, 2B are arranged on upper and lower levels. The lead terminals 2B on the lower level have base end portions 6B that extend a short distance from the rear surface of the connector housing 1 to the bent portions. On the other hand, base end portions 6A of the lead terminals 2A on the upper level are made longer to avoid interference with the lead terminals 2B on the lower level. Accordingly, there is a likelihood that the relatively long base end portions 6A of the lead terminals 2A on the upper level can be deformed due to the interference from the outside.

The present invention was developed in view of the above problem and an object thereof is to prevent the deformation of base end portions of preferably L-shaped lead terminals.

SUMMARY OF THE INVENTION

According to the invention, there is provided a connector for a circuit board, in which lead terminals are so mounted in a connector housing as to at least partially project therefrom and the projecting portions of the lead terminals are bent at an angle different from 0° or 180°, preferably substantially at right angles, for connection with a circuit board. The connector comprises displacement restricting means or structure or a displacement restrictor for engaging at least partially base end portions of the lead terminals extending substantially from the bent portions thereof to the connector housing to restrict in one or more directions the displacement of at least the base end portions.

According to a preferred embodiment, there is provided a connector for a circuit board, in which lead terminals are so mounted in a connector housing as to project and the projecting portions of the lead terminals are bent to be connected with a circuit board, comprising displacement restricting means for engaging base end portions of the lead terminals extending from the bent portions thereof to the connector housing to restrict the displacement of the base end portions.

By providing the displacement restricting means, the deformation of the base end portions of the lead terminals can be prevented. Preferably, the displacement restricting means are provided to substantially project from or be rigidly fixed on the outer surface of the connector housing or is in a fixed disposition or relationship with respect to a surface of the connector housing at a position adjacent or neighboring to the base end portions of the lead terminals. Furthermore the displacement restricting means may project from the connector housing in a direction away from engaging projections of the lead terminals for engagement with a mating connector. Most preferably, the displacement restricting means substantially surround the base end portions of the lead terminals.

According to a further preferred embodiment, the displacement restricting means is so provided as to project from the outer surface of the connector housing and to surround the base end portions of the lead terminals. The base end portions of the lead terminals are protected from an external bending force by being surrounded by the displacement restricting means. Thus, the deformation of the base end portions can be prevented. Preferably, the displacement restricting means extends along a distance corresponding at least to about half the length of the base end portions of the lead terminals. Additionally, the connector housing may comprise an alignment plate for aligning the leading ends of the lead terminals, preferably by passing or inserting them in positioning holes formed therein. The alignment plate may be mounted integrally mounted or mountable on the housing by means of holding means, preferably comprising one or more arms. The displacement restricting means also may be provided to project from the alignment plate and the projecting end thereof may engage the base end portions of the lead terminals.

According to still a further preferred embodiment, the connector housing comprises an alignment plate for aligning the leading ends of the lead terminals by passing them therethrough, and the displacement restricting means is provided to project from the alignment plate and the projecting end thereof engages the base end portions of the lead terminals.

The deformation of the base end portions of the lead terminals can be prevented by the engagement with the displacement restricting means projecting from the alignment plate. Preferably, the base end portions of the lead terminals are fitted into corresponding recesses formed in the displacement restricting means. More particularly, the lead terminals may be fitted into corresponding recesses such that frictional forces between inner walls of the recesses are high enough to substantially prevent the base end portions of the lead terminals from displacement in the corresponding recesses.

These and other objects, features and advantages of the present invention will become more apparent upon a reading of the following detailed description and accompanying drawings.

DETAILED DESCRIPTION OF THE PREFERRED EMBODIMENTS

Figure 1:
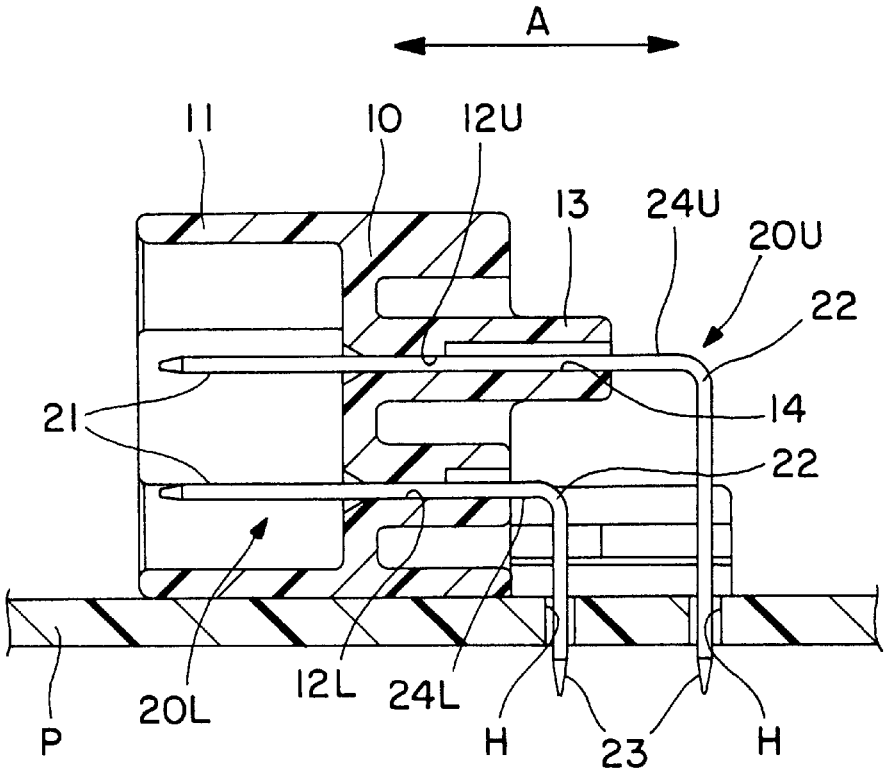
FIG. 1 is a section of a first embodiment.
Figure 2:
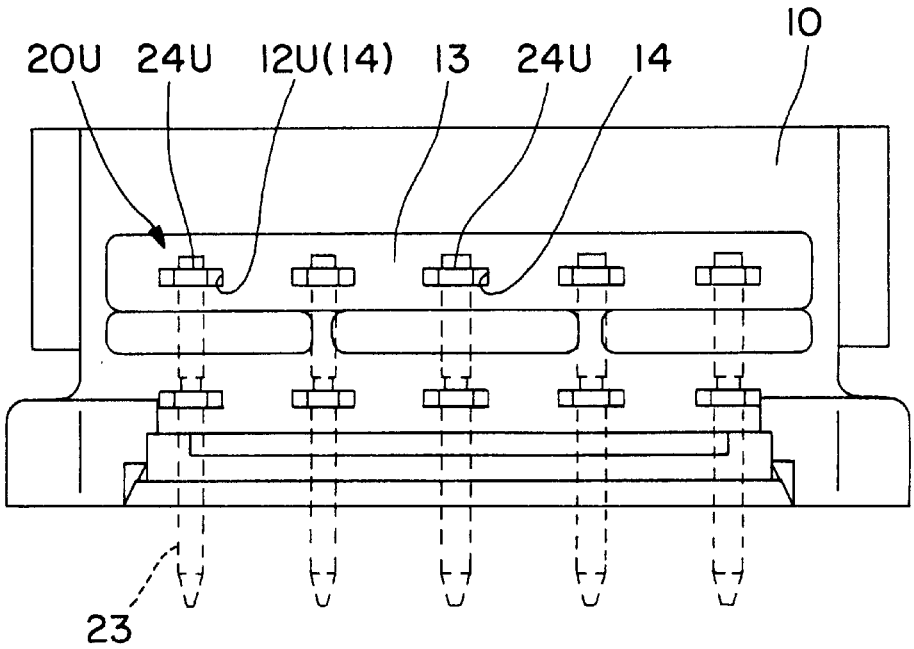
FIG. 2 is a rear view of the first embodiment.

A connector for a circuit board according to a first embodiment of the invention is comprised of a connector housing 10 and a plurality of lead terminals 20U, 20L, as shown in FIGS. 1 and 2. The connector housing 10 has a receptacle 11 in the form of a rectangular tube projecting forwardly for engagement with an unillustrated mating connector housing. A plurality of press holes 12U, 12L extend from the back end surface of the receptacle 11 to the rear surface of the connector housing 10. The press holes 12U, 12L are arranged on upper and lower levels, and e.g. five press holes 12U or 12L are arranged preferably substantially side by side on each level.

Narrow lead terminals 20U, 20L are pressed or inserted or mounted into the press holes 12U, 12L, respectively. The lead terminals 20U to be mounted in the press holes 12U on the upper level are substantially longer than the lead terminals 20L to be mounted in the press holes 12L on the lower level. The front ends of the respective mounted lead terminals 20U, 20L project substantially horizontally into the receptacle 11 and are substantially parallel with each other. Additionally, the lead terminals 20U, 20L are substantially the same length and serve as engaging portions 21 to be brought into contact with unillustrated mating terminal fittings.

Portions of the lead terminals 20U, 20L that project from the rear surface of the connector housing 10 at angles different from 0° or 180°, and preferably at substantially right angles, are bent preferably in respective L-shapes. Leading ends of the lead terminals 20U, 20L that extend downwardly from bent portions 22 serve as mount portions 23 which are to be fitted or inserted into through holes H formed in a circuit board P and secured by unillustrated solder, clamps or the like fixing device.

The portions of the lead terminals 20U, 20L between the bent portions 22 and the rear surface of the connector housing 10 serve as base end portions 24U, 24L. The length of the base end portions 24U of the lead terminals 20U on the upper level preferably are substantially longer than that of the base end portions 24L of the lead terminals 20L on the lower level to avoid the interference with the lower lead terminals 20L.

The connector housing 10 of this embodiment is provided with a means for preventing the deformation of the base end portions 24U of the lead terminals 20U. Specifically, a restricting projection (displacement restricting means) 13 is formed on a surface of the connector housing 10 from which the lead terminals 20U, 20L project. Preferably the restricting projection is defined substantially on the rear surface of the connector housing 10 by projecting a portion of the connector housing 10. In the embodiment illustrated in FIGS. 1 and 2, the opening edge of the upper press holes 12U projects in a direction A of extension of at least a portion of the lead terminals 20U, 20L, and preferably substantially backwardly. A plurality of communication holes 14 (five in this embodiment) are formed in the restricting projection 13 substantially coaxially with the respective press holes 12U. Accordingly, a portion, preferably substantially half of the base end portion 24U of each upper lead terminal 20U near the connector housing 10 is accommodated in the corresponding communication hole 14. In this manner, the restricting projection 13 reinforces and protects the base end portions 24U against an external force acting in such a direction to bend the base end portions 24U by substantially surrounding the base end portions 24U and/or by supporting the base end portion 24U in a direction against a bending force.

The portions of the base end portions 24U of the upper lead terminals 20U surrounded by the restricting projection 13 have their strength against bending enhanced by the rigidity of the restricting projection 13. Further, the exposed portions of the base end portions 24U have an enhanced strength against bending because they are shortened, preferably substantially to half, as compared to the case where the restricting projection 13 is not provided.

Accordingly, the deformation of the base end portions 24U can be prevented securely even if an external bending force in an upward, downward, leftward and/or rightward direction acts on the outer surface of the restricting projection 13 or directly on the base end portions 24U.

The lead terminals 20U are bent after being inserted through the connector housing 10. At this time, jigs (not shown) are placed on the inner and outer sides of the leading terminals 20U with respect to the bent portions. Since the projecting length of the restricting projection 13 is preferably substantially half the length of the base end portions 24U in this embodiment, there is no likelihood that the restricting projection 13 interferes the bending by interfering the jigs.

Figure 3:
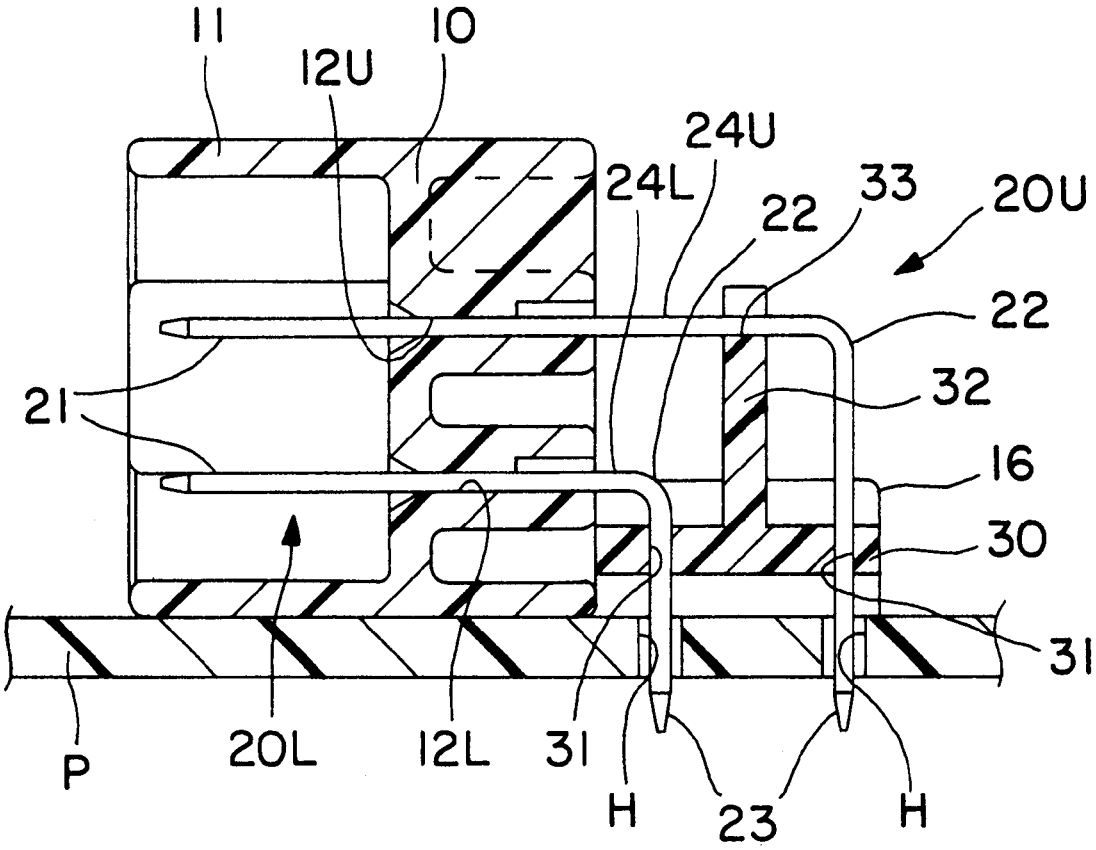
FIG. 3 is a section of a second embodiment.
Figure 4:
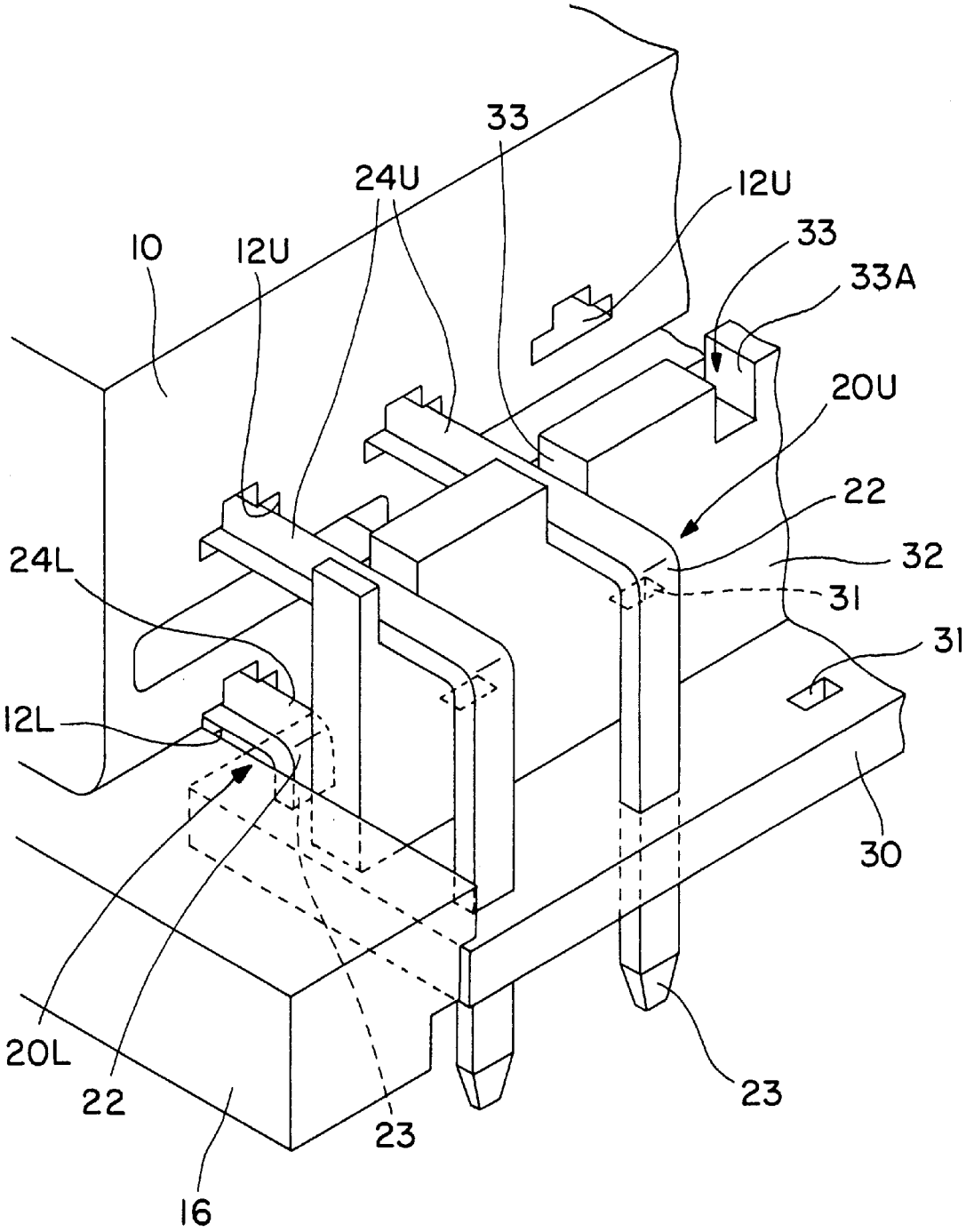
FIG. 4 is a partial enlarged perspective view of the second embodiment.
Figure 5:
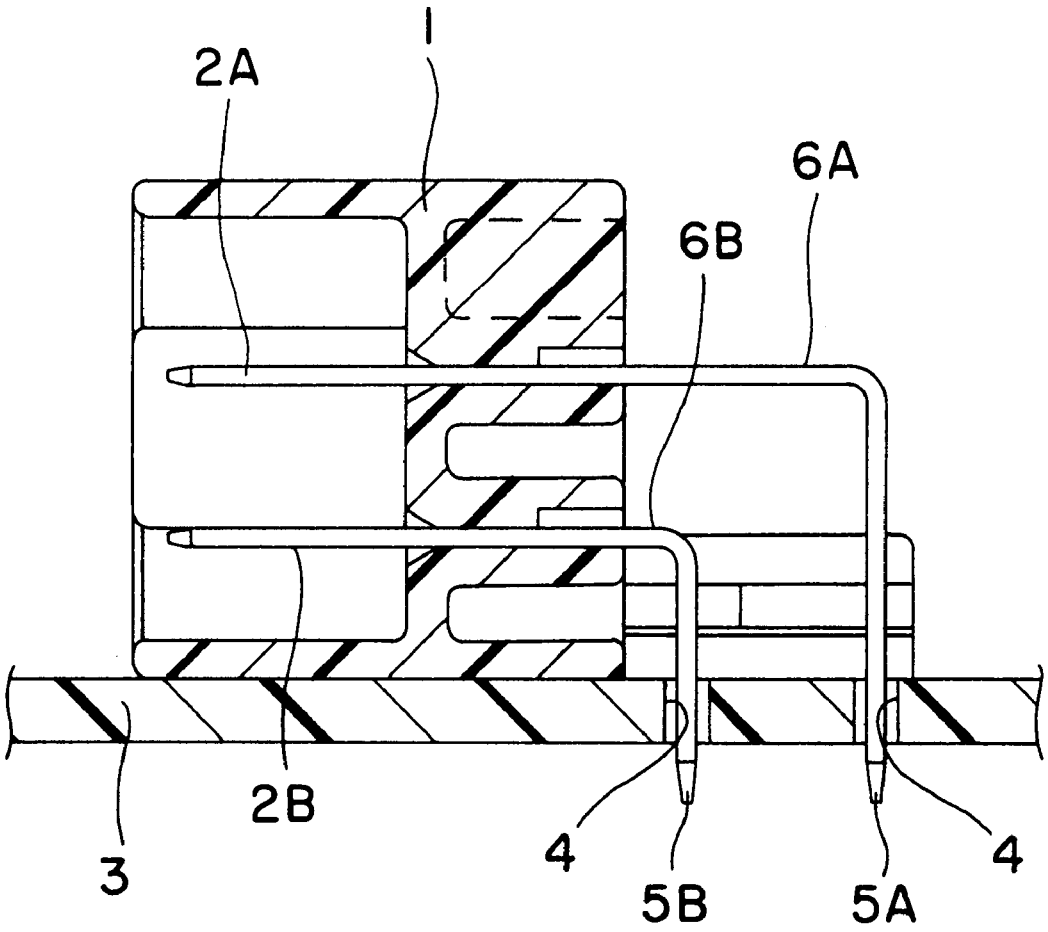
FIG. 5 is a section of a prior art connector.

Next, a second embodiment of the invention is described with reference to FIGS. 3 and 4. This embodiment differs from the first embodiment in the construction of the displacement restricting means. Since the other construction is same as or similar to the first embodiment, no description is given on the structure, action and effects of the same construction by identifying it by the same or similar reference numerals.

In the second embodiment, the connector housing 10 is provided with an alignment or support plate 30 for aligning or supporting the mount portions 23 of the lead terminals 20U, 20L. The alignment plate 30 preferably has a substantially platelike shape as a whole. The opposite lateral ends of the alignment plate 30 are engaged or engageable with arms 16 projecting at a bottom portion of the rear surface of the connector housing 10 preferably from below and held engaged by an unillustrated locking means. This alignment plate 30 is formed with positioning holes 31 corresponding to the mount portions 23 of the respective lead terminals 20U, 20L. The mount portions 23 are so aligned as to conform substantially to the through holes H of the circuit board P by being inserted or insertable through the positioning holes 31.

On the upper surface of the alignment plate 30, a preferably wall-shaped restricting rib 32 (displacement restricting means) stands. In the upper edge of the restricting rib 32 are formed recesses 33 which are engaged or engageable with the respective base end portions 24U on the upper level. With the base end portions 24U at least partially fitted or inserted or positioned in the recesses 33, the loose movement thereof in a downward, leftward and/or rightward direction can be restricted securely. The loose movement of the base end portions 24U in an upward direction also can be restricted or an extent thereof reduced by the frictional resistance with the inner walls 33A of the recesses 33. Accordingly, even if an external bending force acts on the base end portions 24U, the deformation of the base end portions 24U can be prevented securely.

The alignment plate 30 is mounted on the connector housing 10 by being brought closer to the connector housing 10 so as to fit the mount portions 23 into the respective positioning holes 31 and to fit the base end portions 24U in the respective recesses 33.

The present invention is not limited to the described and illustrated embodiments. For example, the following embodiments are embraced by the technical scope of the present invention as defined in the claims. Besides the following embodiments, a variety of changes can be made without departing the spirit and scope of the present invention as defined in the claims.

Although the lead terminals 20U, 20L are arranged on the upper and lower levels in the connector housing 10 in the foregoing embodiments, the present invention is also applicable to connectors for a circuit board in which lead terminals are arranged on one level or on three or more levels.

Although the displacement of the base end portions 24U of the lead terminals 20U arranged substantially side by side is restricted by the single restricting projection 13 in the foregoing embodiments, the restricting projections may independently be formed and/or formed in groups for the respective lead terminals according to the invention.

Although the restricting projection 13 entirely surrounds the base end portions 24U of the lead terminals 20U in the foregoing embodiments, it may be engaged only with the upper and lower surfaces, opposite lateral surface, or any one of the surfaces of each base end portion according to the invention.

What is claimed:

1. A connector for a circuit board, said connector comprising:

a connector housing having opposed front and rear ends and opposed sides, a base wall for mounting on the circuit board, said base wall extending rearwardly from the front end to a location between the ends, a terminal support wall projecting substantially perpendicularly from the base wall, said terminal support wall having a plurality of press holes extending through the terminal support wall in front to rear directions, a hood projecting from said terminal support wall to the front end and defining a receptacle for receiving a mating connector, at least one restricting projection projecting a selected length rearwardly from the terminal support wall, the restricting projection being formed with a plurality of communication holes aligned respectively with the press holes, each said communication hole being cross-sectionally larger than the respective press hole, opposed side arms projecting rearwardly from the base wall more than twice the selected length of the restricting projection to define the rear end of the connector housing, said side arms being disposed respectively at the opposed sides of the connector housing; and a plurality of lead terminals, each said lead terminal having an engaging end projecting forwardly into the receptacle of the connector housing, a supported portion securely engaged in a respective one of the press holes in the terminal support wall, a base end portion extending rearwardly from the supported portion a distance substantially twice the selected length of the restricting projection, such that substantially a front half of each said base end portion is loosely surrounded by the restricting projection, and a terminal mount portion extending substantially perpendicularly from the base end portion at a location rearwardlly from the restricting projection for connection to the circuit board, whereby the restricting projection enables bending of each said lead terminal to form the terminal mount portion without interference with a bending jig, and whereby the restricting projection and the side arms protect the base end portion and the terminal mount portion of each said lead terminal.

2. A connector according to claim 1, wherein the connector housing further comprises an alignment plate extending between the side arms, the alignment plate being formed with a plurality of positioning holes through which the terminal mount ends of the respective terminals pass, such that the alignment plate aligns and protects the terminal mount ends of the lead terminals for mounting on the circuit board.

3. A connector according to claim 2, wherein the side arms are substantially coplanar with the base wall.

4. A connector according to claim 3, wherein the side arms are substantially parallel and have downwardly opening recesses facing one another for receiving the alignment plate therein.

5. A connector according to claim 2, further comprising a displacement restricting wall extending upwardly from said alignment plate, said displacement restricting wall having a plurality of recesses formed therein, sections of the base end portion of each said lead terminal rearwardly of the restricting projection being supportingly engaged in one of the recesses of the displacement restricting wall.

6. A connector for a circuit board, said connector comprising:

a connector housing having opposed front and rear ends, a base wall for mounting on the circuit board, a terminal support wall projecting substantially perpendicularly from the base wall and having a plurality of press holes extending therethrough substantially parallel to the base wall, a hood projecting from said terminal support wall to the front end and defining a receptacle for receiving a mating connector, at least one restricting projection projecting rearwardly from said terminal support wall, said restricting projection being formed with a plurality of communication holes aligned respectively with the press holes in the terminal support wall, each said communication hole being cross-sectionally larger than the respective press holes, a pair of opposed side arms projecting rearwardly from said base wall beyond said restricting projection, and to the rear end of the connector housing;

a plurality of lead terminals, each said lead terminal having an engaging end projecting forwardly into the receptacle of the connector housing, a supported portion securely engaged in a respective one of the press holes in the terminal support wall, a base end portion extending rearwardly from the supported portion through the associated communication hole and to a location between the restricting projection and the rear end of the connector housing, and a terminal mount end aligned substantially perpendicular to the base end portion and extending at least to the base wall of the connector housing;

an alignment plate extending between the arms of the connector housing and being formed with a plurality of positioning holes through which the terminal mount ends of the respective lead terminals extend; and a displacement restricting wall extending upwardly from the alignment plate at a location between the terminal mount ends of the respective lead terminals and the restricting projection, the displacement restricting wall having a plurality of recesses formed therein, said recesses each accommodating a section of one said lead terminal between the restricting projection and the terminal mount end thereof.

7. A connector according to claim 6, wherein the base end portion of each said lead terminal defines a specified length, the restricting projection projecting from the terminal support wall a distance substantially one half the length of the base end portion of each said lead terminal.

* * * * *